US006669107B2

(12) United States Patent
Boecking

(10) Patent No.: US 6,669,107 B2
(45) Date of Patent: Dec. 30, 2003

(54) PRESSURE/STROKE CONTROLLED INJECTOR WITH HYDRAULIC MULTIPLIER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 7 days.

(21) Appl. No.: 10/007,201

(22) Filed: Nov. 8, 2001

(65) Prior Publication Data

US 2002/0074424 A1 Jun. 20, 2002

(30) Foreign Application Priority Data

Nov. 8, 2000 (DE) ..... 100 55 271

(51) Int. Cl.[7] ..... F02M 47/02
(52) U.S. Cl. ..... 239/88; 239/91; 239/96
(58) Field of Search ..... 239/88–96

(56) References Cited

U.S. PATENT DOCUMENTS 4,669,659 A * 6/1987 Leblanc et al.

FOREIGN PATENT DOCUMENTS

DE 198 35 494 A1 2/2000

* cited by examiner

*Primary Examiner*—Steven J. Ganey
(74) *Attorney, Agent, or Firm*—Michael J. Striker

(57) ABSTRACT

An injector for injecting fuel in a combustion chamber of an internal combustion engine has an injector housing, 2/2-way double valves received in the injector housing and coupled with one another for joint vertical movements, a hydraulic multiplier associated with the 2/2-way-control valves, a nozzle chamber which surrounds a nozzle needle and supplied with high pressure fuel by the hydraulic multiplier, the 2/2-way control valves in the housing being turned relative to one another and have valve bodies and guiding elements which surround the valve bodies.

9 Claims, 1 Drawing Sheet

PRESSURE/STROKE CONTROLLED INJECTOR WITH HYDRAULIC MULTIPLIER

BACKGROUND OF THE INVENTION

The present invention relates to a pressure/stroke controlled injector with a hydraulic convertor or multiplier.

In fuel injection systems for injection of fuel in combustion chambers of internal combustion engines nowadays electrically controlled injectors are utilized. Injection start and injection end are adjusted with them. The injectors are mounted preferably by clamping devices on a cylinder head of an internal combustion engine. Thereby injectors which are loaded via a high pressure collecting chamber (common rail) can be mounted on the cylinder head of the internal combustion engines without substantial changes.

German patent document DE 198 235 494 discloses a pump-nozzle unit which operates for the fuel supply in combustion chambers of direct-injection internal combustion engines. For providing a pump-nozzle unit, which has a simple construction, a small size and in particular a short response time it is proposed to form the valve actuator as a piezo electric actuator.

The pump-nozzle unit disclosed in this document has a hydraulic convertor or multiplier device which performs various functions. First, it represents a rigid connection between the valve actuating unit and the control valve and ensures therefore a secure and reliable transmission of the expansion movement of the piezo-electric actuator to the A-valve. Moreover, the expansion movement of the valve actuating unit is deviated by the hydraulic multiplier device into a differently directed valve actuating movement. In the shown example the downwardly oriented expansion movement of the piezo-electric actuator is converted into an upwardly oriented valve actuating movement, or in other words the valve actuating movement oriented in an opposite direction. Moreover, by a respective selection of the surfaces of the valve actuating unit which cooperate with the hydraulic multiplier device on the one hand and the control valve on the other hand, a desired multiplication ratio between the expansion movement of the piezo-electric actuator and the valve actuating movement is provided. Relatively small expansion movements of the piezo-electric actuator can be converted into relatively great valve actuating movements.

Finally, the hydraulic multiplier device serves also as a thermal compensation element between the valve actuating unit and the control valve. In this function, the hydraulic multiplier device compensates the action of various temperature coefficients of the piezo-electric actuator on the one hand and the A valve on the other hand.

SUMMARY OF THE INVENTION

Accordingly, it is an object of present invention to provide a pressure/stroke controlled injector which avoids the disadvantages of the prior art.

More particularly, it is an object of the present invention to provide a pressure/stroke controlled injector which is actuatable by a single control element.

In keeping with these objects and with others which will become apparent hereinafter, one feature of present invention resides, briefly stated, in a combustion chamber of an internal combustion engine, comprising an injector housing; 2/2-way double valves received in said injector housing and coupled with one another for joint vertical movements; a hydraulic multiplier associated with said 2/2-way-control valves; a nozzle chamber which surrounds a nozzle needle and supplied with high pressure fuel by said hydraulic multiplier, said 2/2-way control valves in said housing being turned relative to one another and have valve bodies and guiding elements which surround said valve bodies.

With the proposed solution, a hydraulic multiplier is realized, which is completely forced-compensated, so that the utilized control element must apply small control forces for providing an actuation of the parallel connected 2/2-way control valves. When however such low control forces are required, the inventive injector can be connected with a magnet. With magnets as actuating units, a lasting operation of the injector over the service life of the fuel injection system is ensured.

The force compensation unit of the 2/2-way valves with the hydraulic multiplier is provided by the turning relative to one another with respect to their opening direction. For obtaining the force compensation in the valve body of the 2/2-way valves, the both valve bodies are formed symmetrically, but turned relative to one another. The valve bodies which are movable in the housing of the injector in the vertical direction up and down have a first diameter, while guiding sleeves are received on them and have a second diameter which exceeds the first diameter. The guiding sleeves which have the second diameter are provided with ring-shaped abutment surfaces which limit the maximum vertical covered path of the valve body. Each valve body which operates as the 2/2-way valve is loaded with a spring element which, with the complete force compensation unit of the valve, applies the force to be overcome by the actuating unit.

An overflow connection between both valve chambers is provided between the both parallel actuated, pressure-compensated 2/2-way control valves. An inlet to a hydraulic multiplier branches from the above mentioned overflow connection. It fills the nozzle chamber which surrounds an injection nozzle in the region of a pressure stage, with fuel under high pressure. A closing piston is formed on the nozzle needle and cooperates with a control chamber volume enclosed in a control chamber. The pressure release in the control chamber leads to an outside movement of the nozzle needle from its seat and thereby to a release of the injection openings in the combustion chamber of the internal combustion engine. The control chamber in turn can be pressure loaded with an outlet nozzle released by an actuator.

The parallel connection of the 2/2-way control valve allows a control of the valve body so that during a release of the sealing seat one seat of one of the valve bodies of the 2/2-way control valve, the other moves to its sealing seat and vice versa.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
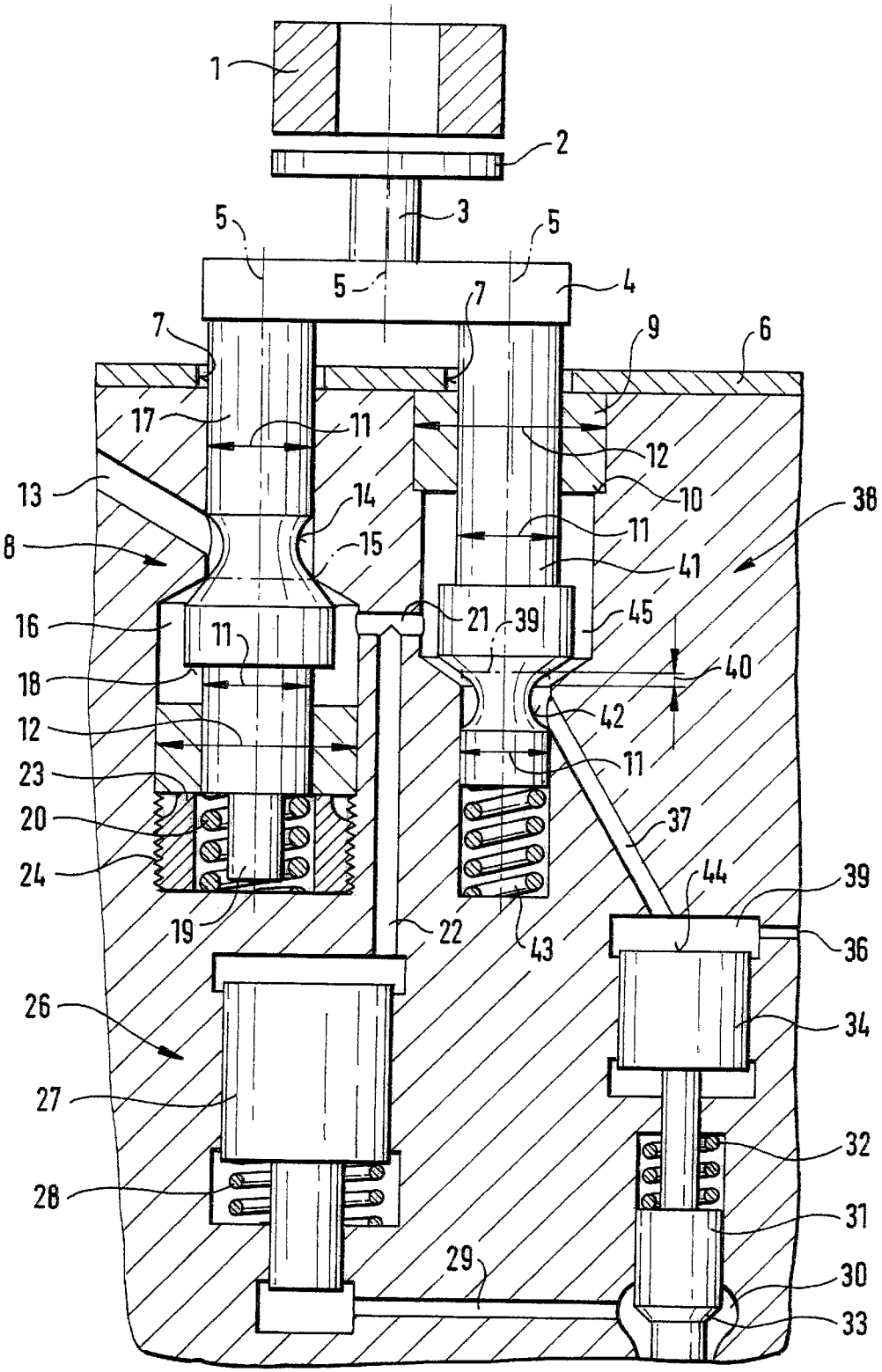
FIG. 1 is a view showing a longitudinal section of an injector housing in accordance with the present invention which receives two neighboring 2/2-way control valves, a hydraulic multiplier as well as a needle nozzle provided with a closing piston.

An inventive injector is shown in a longitudinal section in FIG. 1. Two 2/2-way control valves 8 and 38 are accommodated in a housing of the injector. Under the both 2/2-way control valves 8 and 31, a hydraulic multiplier 26 which is loaded with them for pressure multiplication is located. A needle nozzle 31 provided with a closing piston projection 34 is also located near the multiplier.

The valve bodies 17 and 41 of the both 2-2/way control valves 8 and 38 located near one another are controlled through a common bridge 4. The bridge 4 is a part of a magnetic armature 2 which is controlled by a ring magnetic 1 schematically represented as a magnetic coil. An axial 3 which simultaneously loads the both valve members 17 and 41 is located under the magnetic armature 2. Reference numeral 5 identifies corresponding lines of symmetry both of the axial 3 and of the both valve bodies 17 and 41 located in the injector housing. In the upper region the both valve bodies 17 and 41 of the both 2/2-way control valves have a first diameter 11 and extend through a fixing disc which is provided with openings 7.

A constriction 14 is formed in a first 2/2-way control valve 8 which faces the inlet, on the valve body 17 in the region of the inlet 13 from a high pressure collecting chamber (common rail). The constriction 14 runs of the valve body 17 of the first 2/2-way control valve 8 from a seal diameter 15 which cooperates with a sealing seat provided in the housing. The conical expansion of the valve body 17 connected with the diameter 15 extends to a downwardly extending valve chamber 16. Under the valve body portion which has an increased diameter and which follows the conical extension of the valve body 17, the valve body 17 again assumes the first diameter 11.

The valve body 17 is surrounded inside the valve chamber 16 by a guiding sleeve 23. The guiding sleeve 23 extends with a sealing edge under the sealing action outwardly, into the valve chamber 16 of the housing of the inventive injector. The guiding sleeve 23 has a second diameter 12 which exceeds the first diameter 11 of the valve body 17. The guiding sleeve 23 is secured in the housing of the injector by a screw insert 24. The valve body 17 extends through the guiding sleeve 23 received in the housing with its diameter 11, and at an end surface is provided with a pin-shaped projection 19 which coincides with the upper ring surface of the guiding sleeve 23. The pin-shaped projection 19 is surrounded by a spring 20 which acts on the pin-shaped projection 19 and the lower ring-shaped end surface of the valve body 17. The spring element 20 biases the valve body 17 of the first 2/2-way control valve in a vertical direction upwardly toward the ridge 4.

A transverse opening 21 extends from the valve chamber 16 of the first 2/2-way control valve 8 into a valve chamber 16 of the second 2/2-way control valve 38 in the housing of the inventive injector. A valve body 41 which is movable parallel to the first valve body 17 is received in the valve chamber 16 of the second 2/2-way control valve 38. It is turned relative to the first valve body 17 of the first 2/2-way control valve 8. The valve body 41 formed with the first diameter 11 is surrounded in its upper region by a guiding sleeve 9 which has the second diameter 12. It is extends with a sealing edge 10 outwardly sealingly in the housing of the inventive injector. The guiding element 9 is fixed with the housing, so that the valve body 41 moves parallel to the valve body 17 of the first mentioned 2/2-way control valve engine in the injector housing, through the bridge 4 which acts on both valve bodies. The sealing seat 39 on the valve body 41 is formed opposite to the sealing surface 15 on the first valve body 17. It has conically downwardly reducing sealing surface, while the conical region on the valve body 17 is oriented upwardly.

A constriction 42 under the conical sealing region is provided in the second valve body 41 and extends in the sealing diameter 39. Before the valve body 41 of the second 2/2-way control valve 38 it extends again into the first diameter 11. It is loaded by a spring element 43 at the lower end side of the valve body 41 of the second 2/2-way control valve 38, so that the valve body 41 is biased vertically upwardly. In the region of the constriction 42, for opening or closing by the conical sealing surface 39, a control chamber inlet 37 extends to the control chamber 35. A pressure is applied to it by a closing piston 34 of the nozzle needle 31. The control chamber 35 provided in the injector housing is variable via an outlet throttle 36 with respect to the pressure acting in the control chamber 35. The closing piston 34 of the nozzle needle 31 is displaceable in a hollow chamber inside the housing of the injector and, depending on the pressure change in the control chamber 35, is movable vertically upwardly or downwardly. A sealing spring element 32 acts on the nozzle needle 31 on a ring surface.

An inlet line 22 to a hydraulic multiplier 26 extends from the both valve chambers 16 of the both 2/2-way control valves 8 and 38 at the inlet and outlet side. The hydraulic multiplier 26 includes a piston-shaped element 27 which is biased by spring 28. When the inlet line 22 to the hydraulic multiplier 26 is loaded, a nozzle chamber inlet 29 is loaded with fuel volumes under high pressure, which therefore occurs in a nozzle chamber 30, surrounding the nozzle needle 31 in the region of the pressure stage 36. When the nozzle space inlet 29 is loaded, then the high pressure which acts in the nozzle chamber 30 provides through the pressure stage 33 a vertical outward movement of the nozzle needle 31 against the action of the sealing spring 32, and thereby the upper end side of the closing piston 33 moves inwardly into the surrounding control chamber 35 in the housing of the injector.

A first 2/2-way control valve 8 at the primary side and the second 2/2-way control valve 38 at the outlet side are completely force compensated because of the two identical guiding elements 9 which have both the second diameter 12 as well as because of the valve body 17 and 41 which have the identical diameter 11. The both guiding sleeves 9 and 23 are formed so that on the one hand they are arranged fixed in the housing and on the other hand a sealing action is deployed outwardly. The provided hydraulic diameter in the both valve chambers 16 of the first and the second 2/2-way control valves 8 and 38 are identical.

When the ring magnet 11 is energized, the armature bridge 2 moves in a vertical direction downwardly. Thereby the both valve bodies 17 and 41 of the first and the second 2/2-way control valves 8 and 38 move downwardly. At the inlet side, the vertical downward movement of the conical sealing seat on the valve body 17 provides an opening of the inlet 13 to the high pressure collecting chamber (common rail). The transverse opening 21 is supplied with fuel which is supplied under high pressure in the valve chamber 16 of the 2/2-way control valve located at the inlet side, so that the high pressure fuel volume enters also the valve chamber 16 of the 2/2-way control valve 38 at the outlet side. There the vertical downward movement of the valve body 41 provides the opposite effect. The conical sealing surface 39 on the valve body 41 of the 2/2-way control valve 38 at the outlet side provides a closing movement of the valve body 41 in its sealing seat on the housing of the inventive injector.

During the overflow process through the transverse opening 21 from the valve chamber 16 at the inlet side to the valve chamber 16 at the outlet side fuel with high pressure acts on the hydraulic multiplier 26 through the inlet 22. The piston 21 of the hydraulic multiplier 26 acts on the control volume provided in a control chamber, so that it is provided under high pressure via the nozzle chamber inlet 29 on the nozzle chamber 38 which surrounds the nozzle needle 31. Through the pressure stage 33 on the needle nozzle 31, the needle nozzle 31 moves against the action of the sealing spring 32. The closing piston 34 moves into the control chamber 35, so that with an available stroke path 40 a pressure-controlled injection can be performed.

Since the conical sealing surface 39 on the valve body 41 makes possible covering a stroke way 40, therefore after a first pressure-controlled injection via the hydraulic multiplier 2 a post injection is possible. The stroke-control post injection is made possible by the 2/2-way control valve 38 provided at the outlet side whose conical sealing surface makes possible covering a stroke path 40. For performing a post-injection, the conical sealing region 39 of the valve body 41 of the second 2/2-way control valve remains in an opening releasing position which corresponds to the stroke path 40, so that the control volume can flow out of the control chamber 35. With the highest pressure produced simultaneously in the nozzle chamber, transmitted through the nozzle chamber inlet 29 from the hydraulic multiplier 26, the nozzle needle 31 can open for a short time for performing a post injection.

With the completely pressure equalizing unit of the both 2/2-way control valve 8 and 38 which are received near one another in the injection housing, spring forces transmitted through the restoring springs 20 and 43 are applied to the valve bodies 17 and 41. Hydraulic forces do not have to be overcome by the control element 1 which is common for both 2/2-way control valves 8 and 38. Thereby the injector shown in FIG. 1 can be provided with a magnet, whose longevity is in the region of the service life of a fuel injection system. As for the use of the same components, it is especially advantageous when sleeve elements 9 and 23 which correspond to one another can be used on the valve bodies 17 and 41 of the both 2/2-way control valves. For optimization of manufacture it will be ideal when in the inventive injector the same identical valve body 17 and 41 can be used, which have identical diameters 11 with conical sealing surfaces formed opposite to one another. It should be further mentioned that the constrictions 14 and 42 on both valve bodies 17 and 41 which are displaceable vertically in the injector housing are provided opposite to one another. In FIG. 1 a magnet armature 2, in bridge 4, which is connected with magnet armature 2 are shown schematically. The mechanical connection of the vertical upward movement produced by the control of an energized actuating unit 1 can be performed in a different way. It is important however that the vertical upward or the vertical downward movements of the valve body 17 and 41 of the control valve 2/2-way 8 at the inlet side and the 2-2/way control valve 38 at the outlet side are performed parallel to one another and with the same stroke path.

It will be understood that each of the elements described above, or two or more together, may also find a useful application in other types of constructions differing from the types described above.

While the invention has been illustrated and described as embodied in pressure/stroke controlled injector with hydraulic multiplier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An injector for injecting fuel in a combustion chamber of an internal combustion engine, comprising an injector housing; 2/2-way double valves received in said injector housing and coupled with one another for joint vertical movements; a hydraulic multiplier preceding said 2/2-way-control valves; a nozzle chamber which surrounds a nozzle needle and supplied with high pressure fuel by said hydraulic multiplier, said 2/2-way control valves in said housing being turned relative to one another and having valve bodies and guiding elements which surround said valve bodies, said valve bodies having sealing surfaces oriented opposite to each other.

2. An injector as defined in claim 1, wherein said guiding elements are arranged fixedly in said housing and receive said valve bodies.

3. An injector as defined in claim 1, wherein said guiding elements have a sealing edge extending in said housing outwardly in a sealing fashion.

4. An injector as defined in claim 1, wherein said 2/2-way control valves have valve chambers, said guiding bodies having the same effective hydraulic diameters.

5. An injector as defined in claim 1, wherein said 2/2-way valves have valve chambers; and further comprising an inlet which branches between said valve chambers, said hydraulic multiplier being loaded with pressure through said inlet branching between said valve chamber.

6. An injector as defined in claim 1, wherein said needle nozzle has a closing piston; and further comprising a control chamber which is loaded with pressure above said closing piston from a secondary side of a second one of said 2/2-way control valves.

7. An injector as defined in claim 1; and further comprising an inlet from a high pressure collecting chamber and an additional inlet formed so that during opening of one sealing surface and said inlet from the high pressure collecting chamber through said additional inlet, a second one of said 2/2-way control valves which operates as an outlet valve is closed at its another sealing surface.

8. An injector as defined in claim 1; and further comprising a sealing spring formed so that during closing of said one sealing surface of one of said 2/2-way control valves which is located at an inlet side, said other sealing surface remains open over a stroke path and said nozzle needle is closeable with a stroke-control by said sealing spring.

9. An injector for injecting fuel in a combustion chamber of an internal combustion engine, comprising an injector housing; 2/2-way double valves received in said injector housing and coupled with one another by a bridge for joint vertical movements; a hydraulic multiplier preceding said 2/2-way-control valves; a nozzle chamber which surrounds a nozzle needle and supplied with high pressure fuel by said hydraulic multiplier, said 2/2-way control valves in said housing being turned relative to one another and having valve bodies and guiding elements which surround said valve bodies, said valve bodies having sealing surfaces oriented opposite to each other.

* * * * *